US009377169B2

(12) United States Patent
Suckling et al.

(10) Patent No.: US 9,377,169 B2
(45) Date of Patent: Jun. 28, 2016

(54) HEADLIGHT SYSTEM INCORPORATING ADAPTIVE BEAM FUNCTION

(71) Applicant: SHARP KABUSHIKI KAISHA, Osaka (JP)

(72) Inventors: James Rowland Suckling, Surrey (GB); David James Montgomery, Oxford (GB); Sarah Anne Mitchell, Oxford (GB); Koji Takahashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 204 days.

(21) Appl. No.: 13/948,724

(22) Filed: Jul. 23, 2013

(65) Prior Publication Data

US 2014/0029280 A1 Jan. 30, 2014

(30) Foreign Application Priority Data

Jul. 26, 2012 (GB) ..... 1213299.9

(51) Int. Cl.
*F21V 11/00* (2015.01)
*F21S 8/10* (2006.01)

(52) U.S. Cl.
CPC ..... *F21S 48/17* (2013.01); *F21S 48/1145* (2013.01); *F21S 48/1159* (2013.01); *F21S 48/1208* (2013.01); *F21S 48/1241* (2013.01); *F21S 48/1258* (2013.01); *F21S 48/1747* (2013.01)

(58) Field of Classification Search
CPC ..... F21S 48/1241; F21S 48/215; F21S 48/00; F21S 48/2262; F21S 48/17; F21S 48/1159; F21S 48/1208; F21S 48/1258; F21S 48/1747; G02B 6/0055; G02B 6/3865; G02B 21/0032; G02B 27/0916; G02B 27/0994; B60Q 1/30; B60Q 1/04; G01N 2021/3155
See application file for complete search history.

(56) References Cited

U.S. PATENT DOCUMENTS

| | | | | |
|---|---|---|---|---|
| 6,270,244 | B1 * | 8/2001 | Naum | G02B 6/0006 359/238 |
| 7,654,712 | B2 | 2/2010 | Takeda et al. | |
| 2011/0148280 | A1 * | 6/2011 | Kishimoto | F21S 48/1154 313/483 |
| 2011/0249460 | A1 * | 10/2011 | Kushimoto | 362/510 |
| 2012/0026721 | A1 * | 2/2012 | Kurt | F21K 9/56 362/84 |
| 2012/0051074 | A1 * | 3/2012 | Takahashi | 362/509 |

FOREIGN PATENT DOCUMENTS

| | | | |
|---|---|---|---|
| JP | 2010-232044 | A | 10/2010 |
| JP | 2011-134619 | A | 7/2011 |
| WO | WO 2013/094222 | A1 | 6/2013 |

* cited by examiner

*Primary Examiner* — Jason Moon Han
*Assistant Examiner* — Omar Rojas Cadima
(74) *Attorney, Agent, or Firm* — Renner, Otto, Boisselle & Sklar, LLP

(57) ABSTRACT

A light source system comprising a projection lens, which is capable of producing a far-field image of a light source. The light source comprises a photoluminescent material that when illuminated by light from laser emitters of a first waveband emits light of a second or more wavebands of longer wavelength. The resulting light emission produces a color perceived as white. The light source is illuminated by a plurality of laser emitters arranged to illuminate the light source in an array-like manner from the front side. Control of the output of one or more of the laser emitters results in a variation of the spatial emission distribution from the light source and hence a variation of the far-field beam spot distribution via non-mechanical means. An optical system is arranged to image light emitted from the photoluminescent material into the far-field, which optical system comprises a converging lens.

19 Claims, 20 Drawing Sheets

HEADLIGHT SYSTEM INCORPORATING ADAPTIVE BEAM FUNCTION

This Nonprovisional application claims priority under 35 U.S.C. §119(a) on Patent Applications No. 1213299.9 filed in United Kingdom on Jul. 26, 2012, the entire contents of which are hereby incorporated by reference.

TECHNICAL FIELD

The present invention relates to a headlight system for the provision of an illumination pattern on the road which may be adapted to best suit driving conditions.

BACKGROUND ART

The application of lighting to the automotive industry is well known. The original electric light sources were filament bulbs which offered high luminance from a small source. Improvements in light source design led to halogen type filament bulbs, high intensity discharge (HID) bulbs or high brightness light emitting diodes (LED). These offer improvement in terms of luminance and energy use over preceding filament bulbs. In order to apply these light sources to automotive front lighting and realise the beam spot distributions required by regulatory bodies, such as the United Nations Economic Commission for Europe (UNECE) or Federal Motor Vehicle Safety Standards (FMVSS), for the U.S.A, modification of the output beam to form specific beam spot distributions on the road is necessary. For projector headlights this requires removal of a portion of the light from the projected beam which ultimately forms the beam spot, to create a dipped beam. The dipped beam is necessary to avoid causing glare to oncoming road users. By necessity, the dipped beam also creates a restricted view of the road due to restricted illumination of the same. The removal of light is performed by a shield, which is inserted into the light path thereby causing a reduction in optical efficiency of the projector headlight.

The filament and discharge light sources provide no means for modification of the output from the source. Therefore, a shield is the only method of providing the dipped beam spot distribution pattern. To switch between a dipped beam and a driving beam, the beam pattern that is necessary for better visibility, either two headlights must be provided, one to create the dipped beam and the other to create the driving beam, or a mechanical switching mechanism must be provided. When the driving beam is desired, the mechanical switching mechanism removes the shield from the projected beam profile allowing all light to exit the projector headlight unit unimpeded.

The provision of only a dipped beam distribution, or of only a driving beam distribution, has limitations in terms of road user safety by not providing simultaneous optimal illumination of the road and minimal glare to other road users. This can be improved upon by the addition of an adaptive element to the projected headlight beam. However, all methods of creating an adaptive beam spot from a single projector unit require mechanical moving components within the headlight unit. This has a limitation on cost reduction and reliability of the headlight over the course of its lifetime. Alternative methods of provision of an adaptive beam spot require multiple light source units, which increases the headlight cost, and which also have a large volume, this having implications for pedestrian safety in the event of a collision.

Laser based light sources offer advantage over existing light sources due to the ability to control the emission from the laser diode effectively using optics with a much reduced size, and therefore, weight. This control ability stems from the small emission area and restricted angular distribution of the laser diode. The light emitted from laser diodes is often illuminated onto a fluorescent material to convert from the first wavelength to a second wavelength, which is predominantly white. The light source created is very small and can be used more efficiently with headlight projection optics.

The following background art describes the use of lasers in automotive headlight units:

U.S. Pat. No. 7,654,712 B2 (Koito Manufacturing, 28 Jun. 2006); an illustration of this patent is shown in FIG. 1. A lamp for a vehicle 11 is disclosed as comprising an optical member 12 which distributes the light emitted from the light source 13. The light source is disclosed as comprising a surface emitting laser element 14 which excites a fluorescent substance 15. The surface emitting laser element 14 may be controlled as a function of position to give an adaptively controllable light source 13 with reduced size. The surface emitting laser element 14 is illustrated as being integrated with the fluorescent substance 15, this is shown in FIG. 2 and therefore illuminating the fluorescent substance 15 on a side opposite 16 to the optical member.

US 2012-0051074 A1 (Sharp, 31 Aug. 2010); an illustration of relevant aspect of this patent is shown in FIG. 3. A lighting apparatus 35 is disclosed. The lighting apparatus 35 is formed from a fluorescent member 31 which is illuminated by laser light 32 from the front side 33. The front side is shown as being the same side as the projecting lens 24. The lighting apparatus 35 may be adaptive in beam control through scanning of the laser light 32 across the fluorescent member 31. The illumination spot may have varying position and/or area.

JP 2010-232044 A (Stanley Electric Co, 27 Mar. 2009); an illustration of this patent is shown in FIGS. 4 and 5. The patent discloses a lamp 41 for a vehicle. The lamp 41 is comprised of an array of LED emitters 42 and a fluorescent substance 43. The fluorescent substance 43 is illuminated by a laser emitter 51 (FIG. 5) which is concentrated upon the fluorescent substance 43 by a collimating lens 52. The laser emitter 51 is disposed on the same side of the fluorescent substance 43 as the convex lens 44.

JP 2011-134619 A (Stanley Electric Co, 25 Dec. 2009); an illustration of this patent is shown in FIG. 6. This patent discloses light source device 61 which comprises a solid state light source 62 which illuminates a fluorescent material 63. The light emission 64 from the fluorescent material 63 is projected into the far field by a lens system 65. The light from the solid state light source 62 may be controlled by an articulated reflector 66. The fluorescent material 63 is illuminated from the same side as the lens system 65.

FIG. 7 is an illustration of the basic form of a typical projector type light source system 74. A source of light 71 is located at the primary focal point 72 of an ellipsoidal reflector 73. The light emission 75 from the source of light 71 is directed to the secondary focal point 76 of the ellipsoidal reflector 73. A projection lens 714 images the distribution of brightness at the secondary focal point 76 into the far-field, to form a beam spot. Adaptive control of such a projector type light source system 74 requires mechanical control comprising either re-orientation of the entire system, or complex mechanisms which modify the distribution of brightness at the second focal point 72. The complex mechanisms are well known and will not be described further.

US 2011/0249460 (T. Kushimoto, 13 Oct. 2011), proposes a vehicle headlight having an array of phosphor squares, which are illuminated by light from blue laser sources. Light from a laser source is directed onto the back surface of the phosphor grid by a mirror.

SUMMARY OF INVENTION

A first aspect of the invention provides a light source system operable in at least first and second modes to provide at least and first and second different far field illumination patterns, the system comprising: a photoluminescent material; and an optical system arranged to image light emitted from the photoluminescent material into the far-field, the optical system comprising a converging lens; and a light beam generator for generating at least first and second independently controllable sets of one or more light beams for illuminating respective regions of the photoluminescent material; wherein the light beam generator comprises at least one semiconductor light emitting device spatially separated from the photoluminescent material; and wherein the light source system is arranged so that the first and second sets of one or more light beams illuminate, in use, a surface of the photoluminescent material facing the converging lens. By causing the generating means to generate a first set of one or more light beams so as to illuminate one region of the photoluminescent material, the one region of the photoluminescent material is caused to emit visible light and thus generate one far field illumination pattern, whereas causing the generating means to generate a second set of one or more light beams so as to illuminate another region of the photoluminescent material, the another region of the photoluminescent material is caused to emit visible light and thus generate another far field illumination pattern. By specifying that the sets of light beams are independently controllable is meant that the intensity of the light beam(s) of one set is controllable independently of the intensity of the light beam(s) of the other set, and optionally that the or any light beam of one set is controllable independently of the intensity of the or any light beam of the other set. (It should be noted that the region of the photoluminescent material that is illuminated by a first set of light beams may or may not overlap the region of the photoluminescent material that is illuminated by a second set of light beams.)

For the avoidance of doubt, the first set of light beams and/or the second set of light beams may consist of only a single light beam.

Also for the avoidance of doubt, a light source system of the invention is not necessarily limited to operation in just the first and second modes and in principle may also be operable in one or more further modes in addition to the first and second modes, so that the system is able to provide one or more further far field illumination patterns in addition to, and different from, the first and second different far field illumination patterns.

BRIEF DESCRIPTION OF DRAWINGS

In the annexed drawings, like references indicate like parts or features.

DESCRIPTION OF REFERENCE NUMERALS

Figure 1:
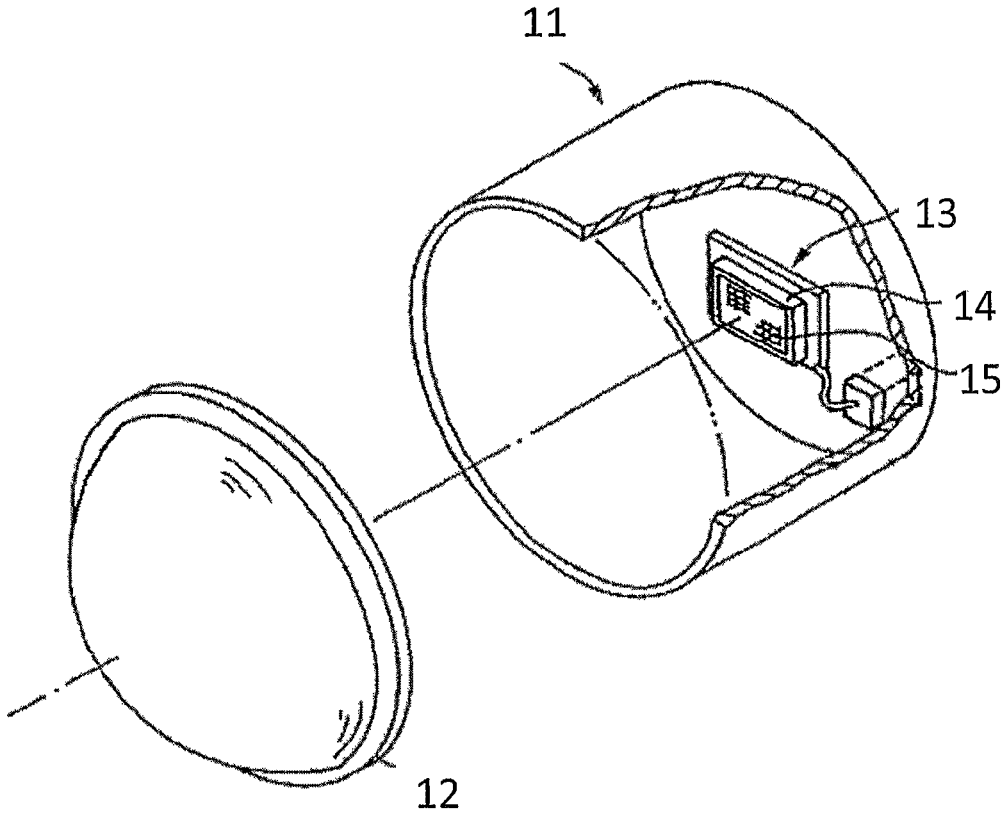
FIG. 1 PRIOR ART
FIG. 1: example of a laser based lamp for a vehicle with lens projection, constituting a convention art.
Figure 2:
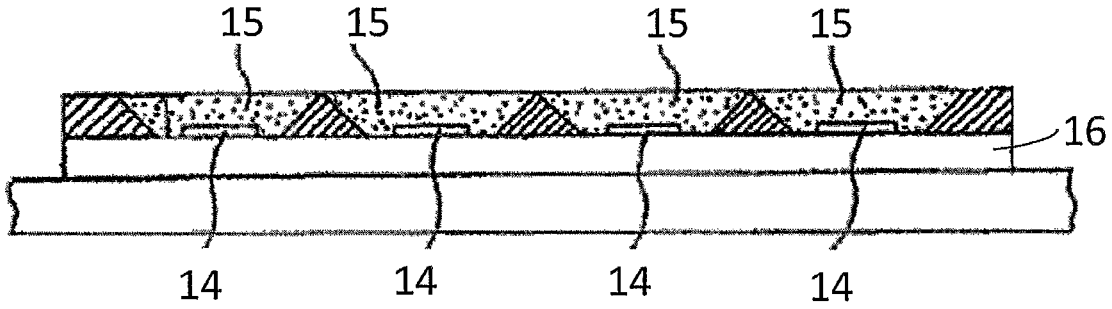
FIG. 2 PRIOR ART
FIG. 2: further detail of laser based lamp for a vehicle with lens projection, constituting a conventional art.
Figure 3:
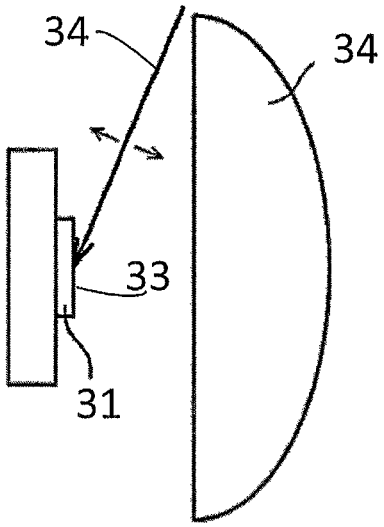
FIG. 3 PRIOR ART
FIG. 3: example of a laser lased lighting source with lens projection, constituting a convention art.
Figure 4:
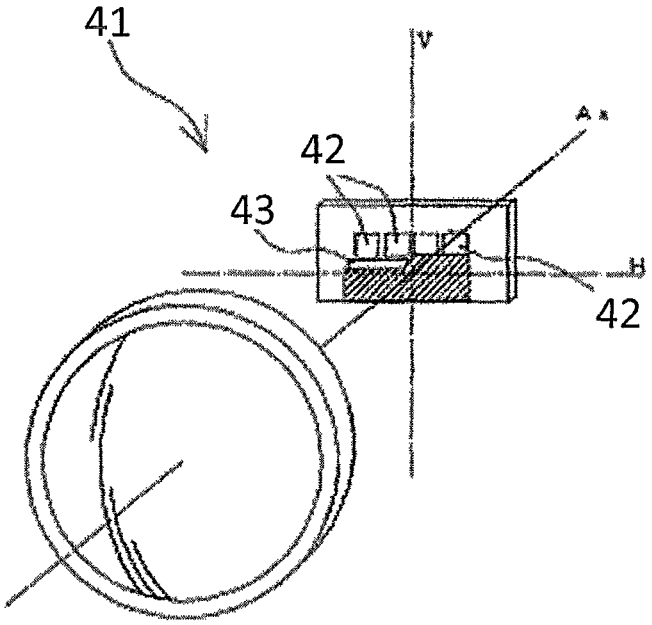
FIG. 4 PRIOR ART
FIG. 4: example of a lamp for a vehicle based upon laser and LED emitters, constituting a conventional art.
Figure 5:
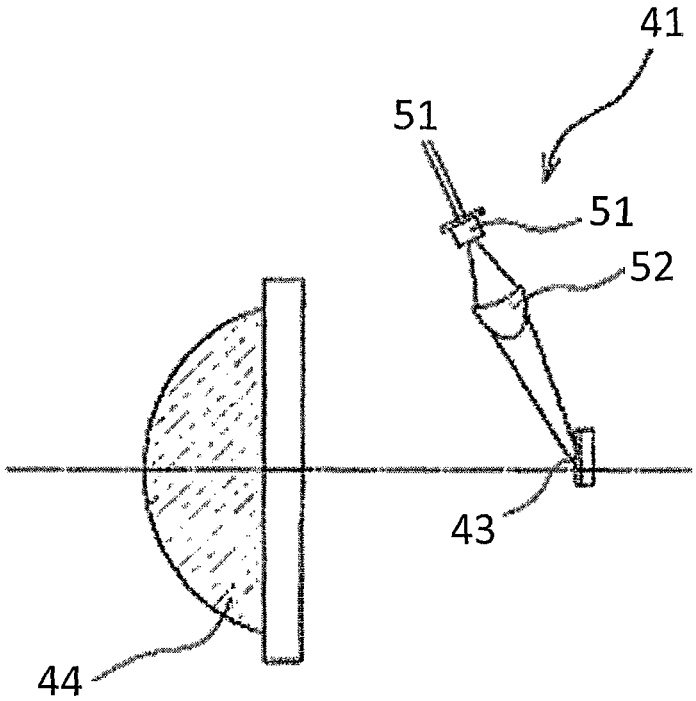
FIG. 5 PRIOR ART
FIG. 5: further detail of a lamp for a vehicle based upon laser and LED emitters, constituting a conventional art.
Figure 6:
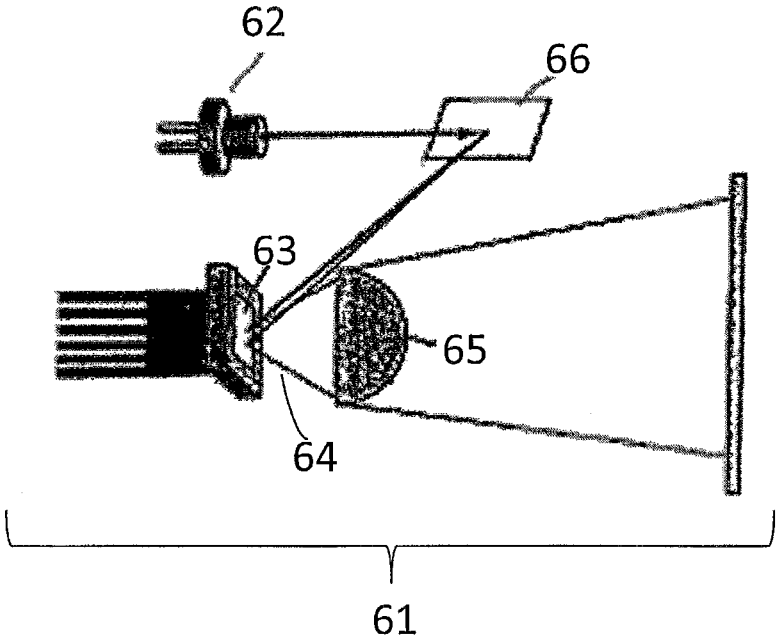
FIG. 6 PRIOR ART
FIG. 6: a laser based light source device, constituting a conventional art.

11. lamp for a vehicle (prior art 1)
12. optical member (prior art 1)
13. light source (prior art 1)
14. surface emitting laser element (prior art 1)
15. fluorescent substance (prior art 1)
16. opposite side to optical member (prior art 1)
31. fluorescent member (prior art 2)
32. laser light (prior art 2)
33. front side (prior art 2)
34. projecting lens (prior art 2)
35. lighting apparatus (prior art 2)
41. lamp (prior art 3)
42. LED emitters (prior art 3)
43. fluorescent substance (prior art 3)
44. convex lens (prior art 3)
51. laser emitter (prior art 3)
52. collimating lens (prior art 3)
61. light source device (prior art 4)
62. solid state light source (prior art 4)
63. fluorescent material (prior art 4)
64. light emission (prior art 4)
65. lens system (prior art 4)
66. articulated reflector (prior art 4)
71. source of light (prior at 5)

72. primary focal point (prior art 5)
73. ellipsoidal reflector (prior art 5)
74. projector type light source system (prior art 5)
75. light emission (prior art 5)
76. secondary focal point (prior art 5)
81. light beam generator
82. light beams
83. laser emitters
84. optical fibres
85. output face (of the optical fibres)
86. heat sink
87. laser emitter array
88. light source system
89. light source
810. photoluminescent material
811. substrate
812. illumination spots
813. secondary light
814. projection lens
815. control lenses
816. acceptance cone
817. illuminated side (of light source)
818. optical axis
819. focal plane
820. array
821. boundary (within array)
822. protruding optical fibres
823. recessed optical fibres
91. radial size
92*a*. external surface (of the projection lens)
92*b*. external front surface (of the projection lens)
101. ellipsoidal reflector
102. first focal point
103. second focal point
141. headlight unit
142. automobile
143. central control unit
144. beam spot distribution on the road
145. road
146. driver console
147. camera
148. oncoming automobile
149. person

DETAILED DESCRIPTION OF INVENTION

Figure 8A:
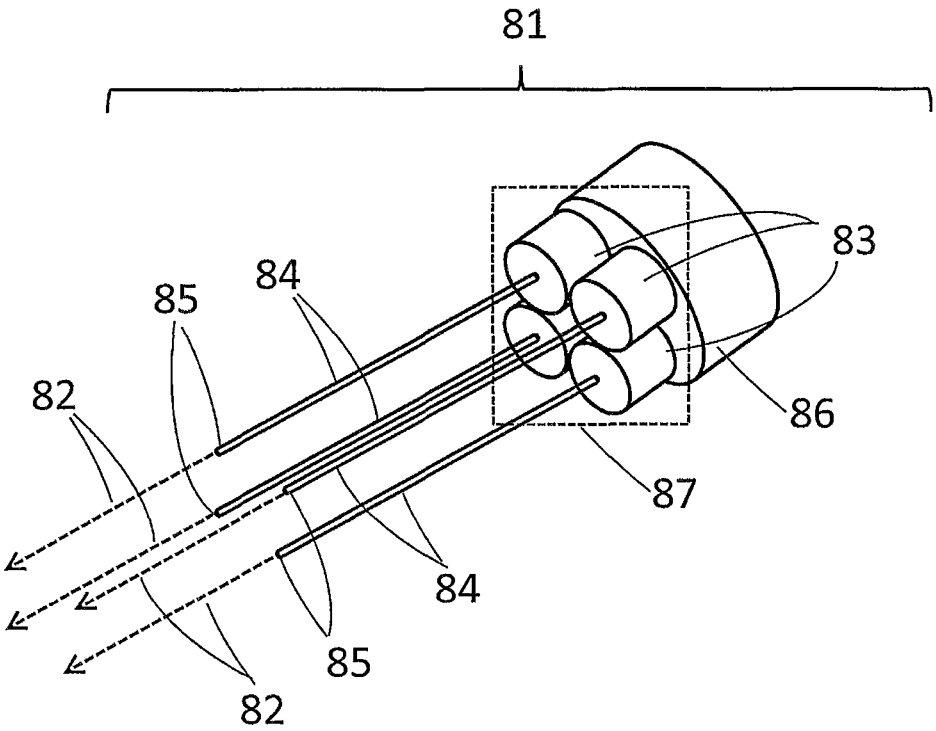
FIG. 8*a*: detail of main embodiment of the present invention; a light beam generator.
Figure 8B:
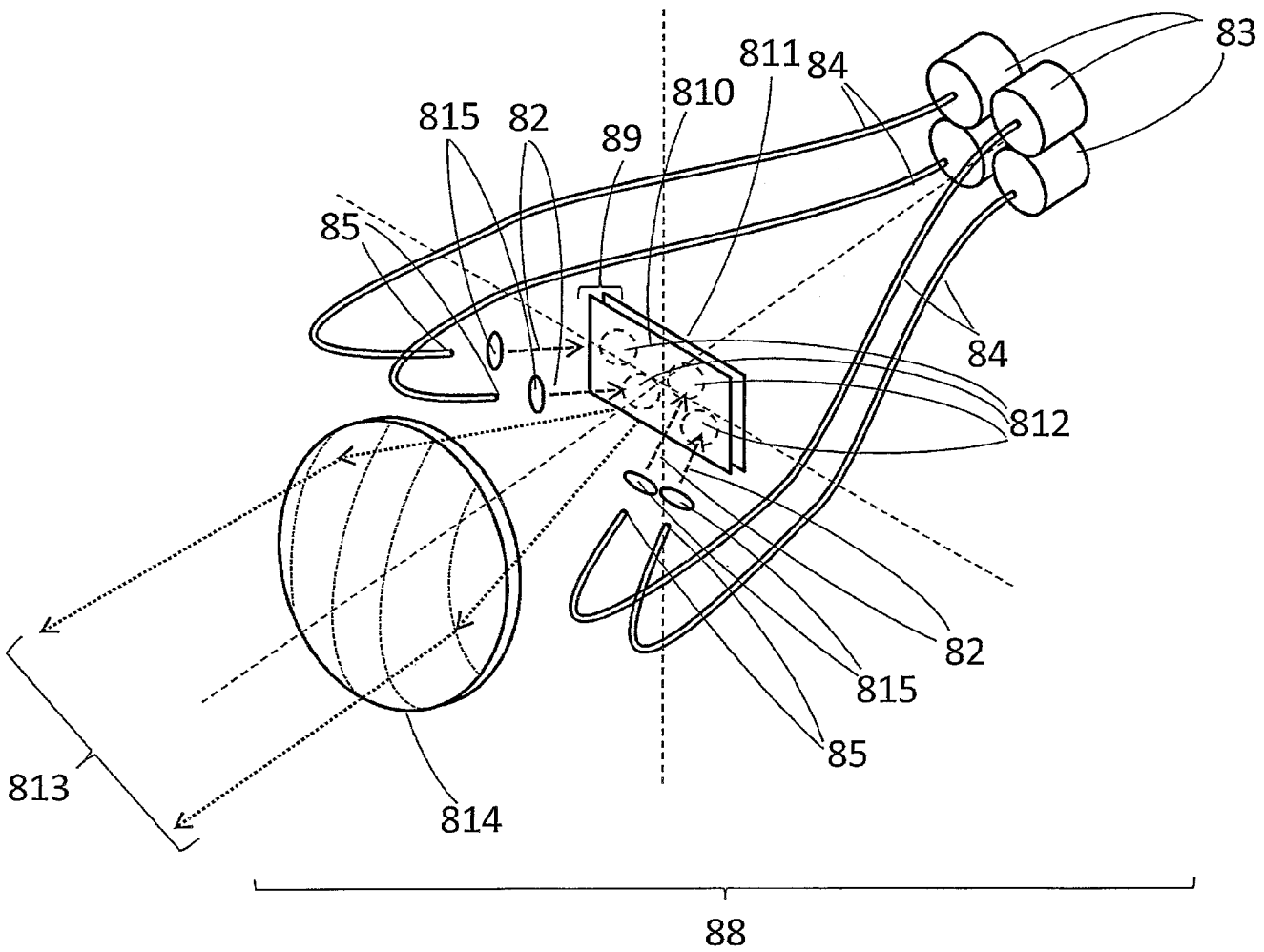
FIG. 8*b*: detail of main embodiment of the present invention; the light beam generator and light source system.

The main embodiment of the present invention is described herein. FIG. 8*a* shows one aspect of the present invention. FIG. 8*b* shows the aspect of FIG. 8*a* incorporated into the larger system of the present invention, but in simplified form for clarity. FIG. 8*a* shows a light beam generator 81 is constructed such that it may generate multiple light beams 82. In its simplest form the light beam generator 81 may comprise multiple laser emitters 83, but should not be limited to such. Indeed, in the preferred embodiment of the present invention the light beam generator 81 is comprised by multiple laser emitters 83, the light from which is coupled into optical fibres 84 which transport the laser light emitted from the laser emitters 83 to a location remote from the laser emitters 83. The output face 85 of the optical fibres 84 then becomes the point at which the light beams 82 exit the light beam generator 81. The laser emitters 83 may be mounted on a heat sink 86 if necessary. From herein the heat sink 86 will be omitted from figures for clarity, but may always be associated with the laser emitters 83 or a laser emitter array 87. A laser emitter array 87 being defined as the collective term for a group of individual laser emitters 82.

Figure 8C:
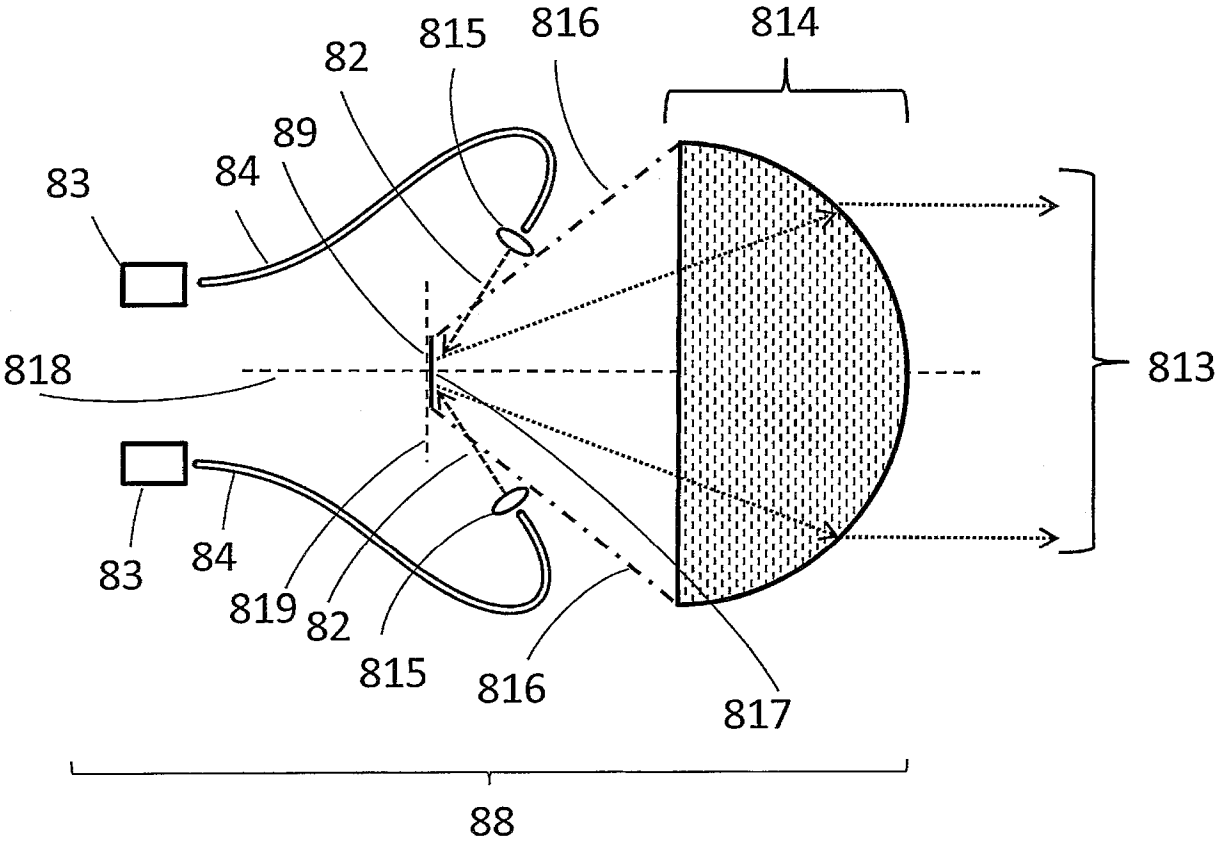
FIG. 8*c*: detail of main embodiment of the present invention; side view of the light source system and light beam generator.

FIG. 8*b* shows the incorporation of the light beam generator into a light source system 88. The light beam generator is formed from multiple laser emitters 83 and optical fibres 84 and emits light beams 82 of a first waveband. The light beams 82 of the first waveband from the laser emitters 83 are directed onto a light source 89 comprising a photoluminescent material 810 which is deposited onto a substrate 811. From herein the light source 89 will generally be shown as one object for clarity. The individual light beams 82 form an array of illumination spots 812 on the light source 89 which are distinct, but not necessarily separated from one another. The photoluminescent material 810 converts the light of the first waveband into light of a second or more wavebands with longer wavelength. The secondary light 813 of the second waveband subsequently emitted from the light source 89 is collected by an optical system comprising a converging lens, in this embodiment formed by a projection lens 814, which images the light source 89 into the far field. The optical fibres 84 of the light beam generator 81 are arranged such that the output faces 85 are located on the same side of the light source 89 as the projection lens 814. Although the output faces 85 of the optical fibres 84 are one particular side of the light source 89, it is not necessary for the laser emitters 83 to be located on this same side. Indeed, the laser emitters 83 may be located to the other side, or even in a position remote from the light source 83 and projection lens 814. The distance between the laser emitters 83 and the light source 89 is only limited by the capability of the optical fibres 84 to transmit the laser light. The length of the optical fibres 84 may be between 0.05 meters and 10 meters, or longer, if appropriate. The light beams 82 emitted from the optical fibres 84 are directed onto the light source 89 by optical components, in this example by control lenses 815. Optionally, a plurality of optical components (in this example a plurality of control lenses 815) are provided for directing the output from a respective optical fibre onto a respective region of the light source 89. The control lenses 815 act to image the output face 85 of the optical fibres 84 onto the light source 89. The array of illumination spots 812 is formed by the arrangement of the images of the output faces 85 of the optical fibres 84. Detail of the arrangement of the optical fibres 84 and control lenses 815 is shown in FIG. 8*c*, this comprises a side view of the light source system 88 as shown in FIG. 8*b*. The optical fibres 84 and control lenses 815 are arranged such that they are outside the angular acceptance range of the projection lens 814 (that is, outside the acceptance angular cone 816 of the projection lens 814 (which is a converging lens)). By this arrangement, there is no light loss back into the optical fibres 84 therefore, there is no reduction in efficiency of the light source system, as by definition any light which now enters back into the optical fibres 84 could not be projected by the projection lens 814 in the first place. It should be noted that, by contrast, it is acceptable for the light beams 82 to be within the acceptance cone 816 of the projection lens 814 (ie, within the angular acceptance range of the projection lens 814). The light beams 82 will not interact with the secondary light 813 and can therefore not affect the far-field beam spot. Indeed, it is necessary for the light beams 82 to enter the acceptance cone 813 of the projection lens 814 to be able to illuminate all points of the light source 89 effectively. The laser emitters 83 are also shown to be the opposite side of the light source 89 to the illuminated side 817 and the projection lens 814.

Also in FIG. 8*c*, the light source 89 is shown to be perpendicular to the optical axis 818 of the projection lens 814. By this configuration, the light source 89 is in the plane of the focal plane 819 of the projection lens 814. This arrangement is optimal for efficient and accurate projection of the brightness distribution of the secondary light 813 emitted from the light source 89. If the light source 89 is rotated out of the focal plane 819 the image quality within the far-field distribution will deteriorate. However, it is possible for some rotation away from the focal plane 819 before significant degradation occurs. Therefore, although having the light source 89 coplanar with the focal plane 819 is the preferred arrangement, it should not be limited to such a strict alignment.

For the purposes of description of the present invention, when describing the light source 89, it is understood that the term "illumination spot" is directly equivalent to "emission spot" as the light source 89 only emits light of the second or more wavebands from a position illuminated by light of the first waveband from the laser emitters 83 and that emission of light from the light source 89 is otherwise not possible. Therefore, discussion of illumination from the laser emitters 83 implicitly indicates emission from the light source 89.

The laser emitters 83 may be replaced with other semiconductor light emitters, for example light emitting diodes (LED) which are applied with a suitable collimating optic to direct the light from the LED onto the photoluminescent material 810 of the light source 89. Use of such LEDs will result in a headlight which is significantly larger than one constructed using laser emitters.

The photoluminescent material 810 may be made from phosphors and deposited on the substrate 811 in a thin layer, the manufacture of which is well known and will not be disclosed further within this invention. The constituent parts of the photoluminescent material 810 may vary depending on the wavelength of the first waveband and hence the formation of the second or more wavebands of light may be via two routes. Firstly, the light of the first waveband may be non-visible, or have a wavelength such that it generates a very low response in the human eye, such wavelengths being 415 nm or shorter. In this instance, the photoluminescent material 810 may be constituted of a combination of two or more of red, green, blue or yellow phosphors which are caused to emit light within the red, green, blue or yellow second wavebands respectively when illuminated by light of 415 nm or shorter. The combination of two or more of the aforementioned second wavebands, but excluding the first waveband produced by the laser emitter, may be mixed to produce light perceived as white. The second method of producing white light via the use of a first waveband in the range 430 nm to 470 nm and a combination of one or more of a red, green or yellow phosphor which is caused to emit light within the red, green or yellow second wavebands respectively when illuminated by light within the range of 430 nm to 470 nm. The combination of the part of light of the first waveband that is not absorbed by the photoluminescent material 810 and one or more of the second wavebands produces light with a colour perceived as white.

Figure 8D:
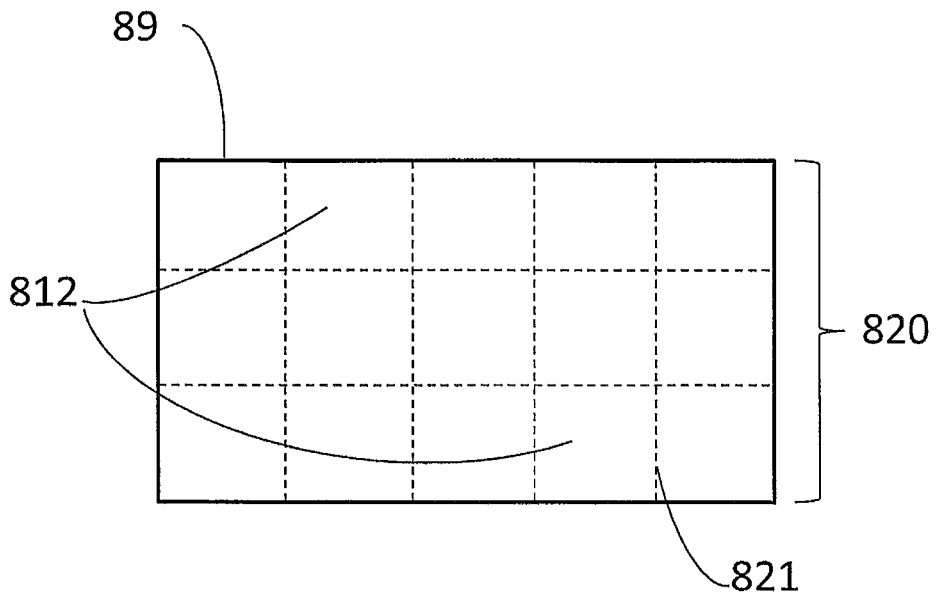
FIG. 8*d*: detail of the main embodiment; illustration of an example array of illumination spats upon the light source.

FIG. 8*d* shows a plan view of the light source 89 in which the illumination spots 812 form an array 820 which illuminates the whole of the light source 89, the dashed lines representing boundaries 821 between the different illumination spots 812. Each laser emitter illuminates an individual illumination spot 812. It is not necessary for the illumination spots 812 to be contained completely within the array boundaries 821 and some overlap of the adjacent cells of the array 820 is allowed, but this is not shown for clarity of the illustration. The relative intensity of each section of the array 820 on the light source 89 may be controlled by altering the output power of each of the laser emitters, thereby controlling the intensity of emission from the light source 89 as a function of spatial position. The spatial brightness variation of the light source 89 is imaged into the far-field by the projecting lens 814, thereby creating a freely adaptive beam spot. For example, in a first mode of operation a first set of laser emitters may be caused to emit light and thereby generate a first set of light beams that illuminate a first set of illumination spots 820 on the photoluminescent material leading to a first far field illumination pattern, and in a second mode of operation a second set of laser emitters may be caused to emit light and thereby generate a second set of light beams that illuminate a second set of illumination spots 820 on the photoluminescent material leading to a second, different far field illumination pattern. The first set of laser emitters is different to the second set of laser emitters, but it is possible for there to be some overlap between the first and second sets of laser emitters (ie one or more laser emitter may belong to both the first set and the second set). Where the invention is applied to a headlight for a motor vehicle, the first far-field illumination pattern may for example provide a dipped beam and the second far-field illumination pattern may provide a driving beam. If a system of the invention is operable also in one or more further modes to provide one or more further far field illumination patterns, the further far-field illumination pattern(s) may provide adaptive control to the driving beam and/or the dipped beam.

The individual illumination spots 812 within the array 820 may be each formed from the light from individual single laser emitters. Alternatively, it is also possible for the individual illumination spots 812 to be formed from the light from more than one laser emitter. In the case of the latter, the light from the multiple laser emitters is expected to overlap completely to provide a single illumination spot 812, such that the variation of output from the laser emitters incorporated into one illumination spot 812 will only result in a change in brightness of emission from the illuminated spot 812 and not a change in shape of the illumination spot 812. This will offer a degree of redundancy if one of the laser emitters should happen to fail or reduce in output power. The complete array 820 can then still formed from multiple illumination spots 812, each formed by illumination from multiple laser emitters.

Further information on possible shapes, orientations and sizes of the illumination spots as formed upon the light source are outlined in further detail in co-pending UK patent application GB 1122183.5.

Figure 7:
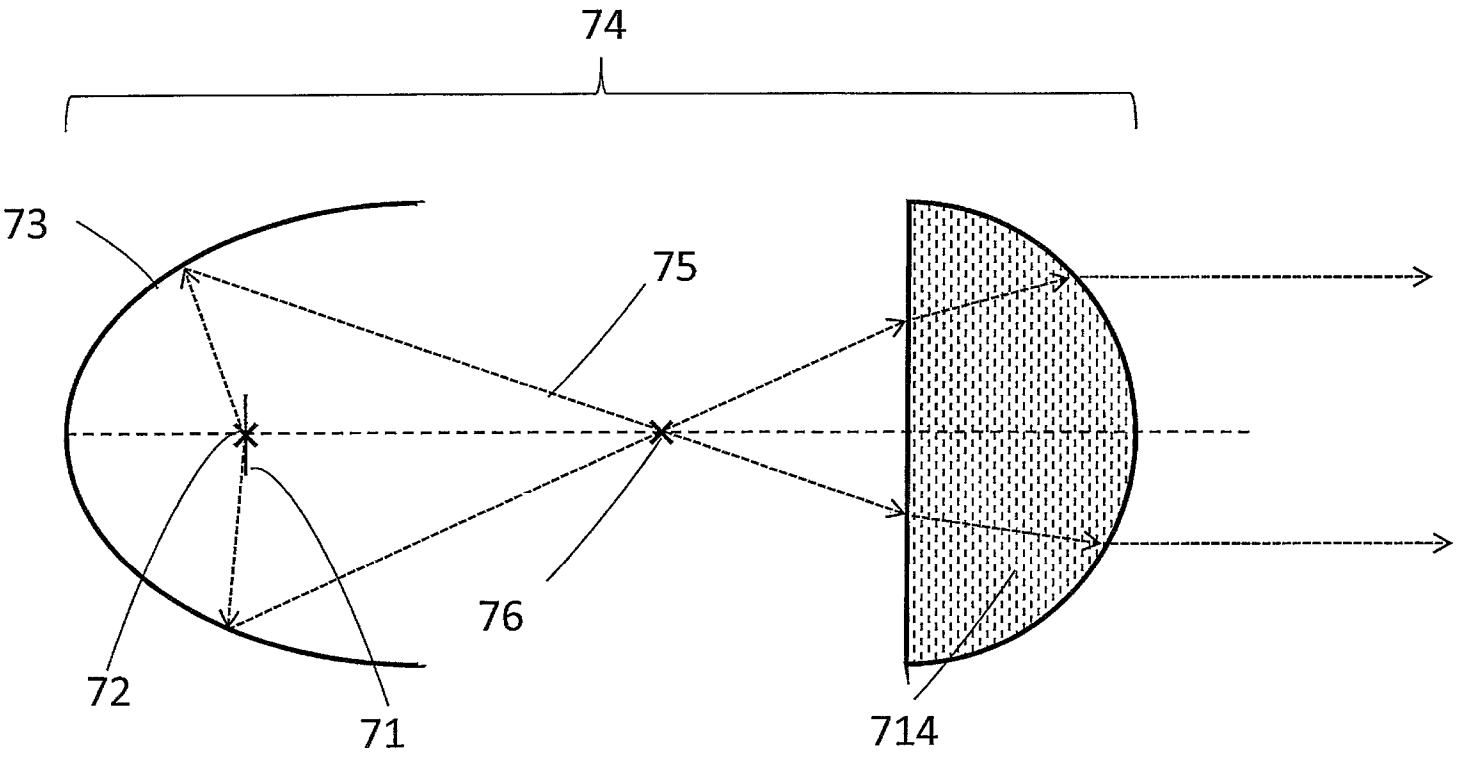
FIG. 7: a typical reflector and projector lens based light source system, constituting a conventional art.

One advantage of the current invention arises from the arrangement of the illuminations spots 812 on the light source 89 to give freedom in the creation of such a light source 89 with freely controllable spatial variation in the intensity of the emitted light without mechanical components. By this means the whole adaptive light source system is electronically switchable. Further advantage is offered by the use of a projection lens 814 to project the emission distribution of brightness from the light source 89 into the far field. The use of a single projection lens 814, as opposed to a lens and reflector type projection system, as shown in FIG. 7, reduces the size of the light source system. Furthermore, removal of a reflector from the system improves both the efficiency of projection into the far-field beam spot and the quality of the reproduction of the light source distribution within the beam spot. The optical system may be described as consisting solely of a projection lens, or similarly, a converging lens. The term 'solely' indicates that only the converging lens is used for reproduction of the light source into a beam spot distribution in the far-field. However, the use of the word solely is not intended to rule out the possible addition of other components to the optical system through which the light may pass, but which do not operate to create the desired beam spot distribution in the far-field, for example a clear, protective cover, which may be found on almost all vehicle headlights to give protection from the environment, and use of the term "solely" is not intended to exclude provision of a protective cover to provide environmental protections for the light source. Further components may include a filter, which might be included to remove the illumination laser light for safety reason. Again such a filter would not affect the beam spot distribution or shape and use of the term "solely" is accordingly not intended to exclude provision of a filter. The two extra components above are given by way of example, but should not be limited to such.

Figure 9A:
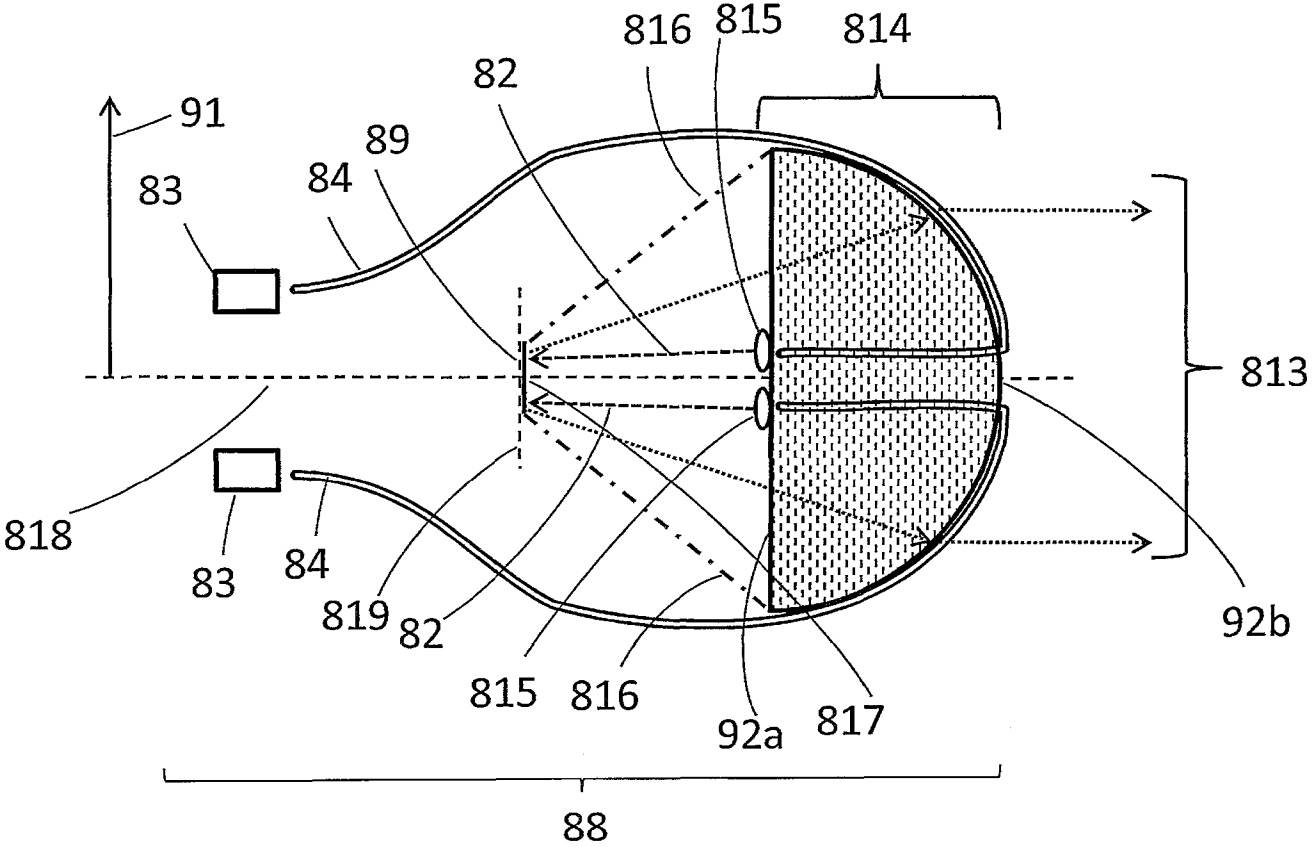
FIG. 9*a*: a further embodiment of the present invention; a configuration whereby the optical fibres are arranged within the body of the projection lens.

FIG. 9*a* illustrates a further embodiment of the present invention. The light source system 88 is shown in side view. The light source 89 is located in the focal plane 819 of the projection lens 814. The laser light generator is comprised of multiple laser emitters 83 and optical fibres 84 which transport the light from the laser emitters 83 to the output face 85 of the optical fibres 84. The light beams 82 from the optical fibres 84 are directed and imaged onto the light source 89 by control lenses 815. The secondary emission 813 from the light source 89 is imaged into the far-field by the projection lens 814. But in contrast to earlier embodiments, the optical fibres 84 are arranged to be extend at least partially through the projection lens 814 itself. Similarly the control lenses 815 are located in close proximity 91 to the projection lens 814. By this arrangement the optical fibres 84, control lenses 815 and light beams 82 are within the angular acceptance range of the projection lens 814 (that is, are within the acceptance cone 816 of the projection lens 814). The image projection into the far-field is unaffected if the optical fibres 84 and control lenses 815 remain in close proximity to the projection lens 814 and do not encroach on the focal plane 819 of the projection lens 814. Close proximity to the projection lens 814 may be defined as being no further from an external surface 92*a* and 92*b* of the projection lens 814 than the projection lens focal length multiplied by 0.75. By this arrangement, loss of the secondary emission 813 may occur back into the optical fibres 84, hence introducing a loss route not present in the main embodiment, but the radial size 91 of the whole light source system 88 is reduced, and similarly the volume of the light source system 88 is also reduced. The radial size 91 of the light source system 88 is defined as the dimension of the light source system 88 along the radial distance from the optical axis 818.

Figure 9B:
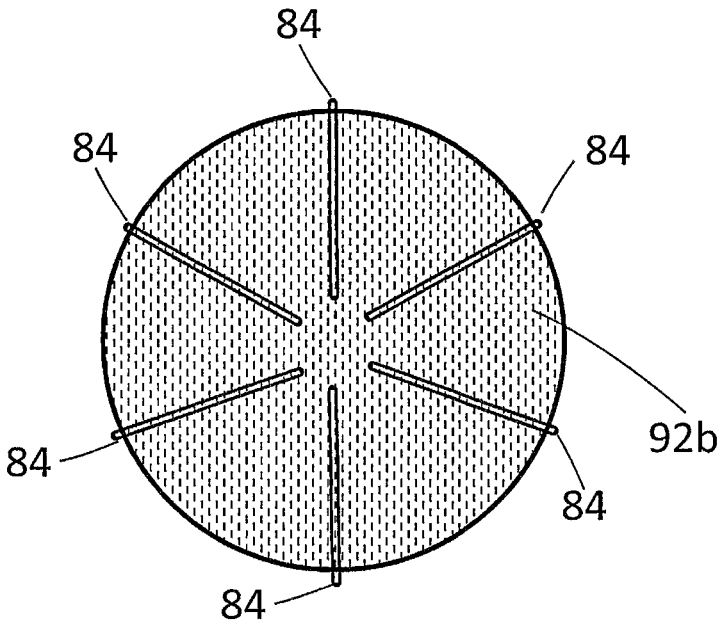
FIG. 9*b*: further detail of an embodiment of the present invention; illustration of optical fibres with respect to the projection lens.
Figure 9C:
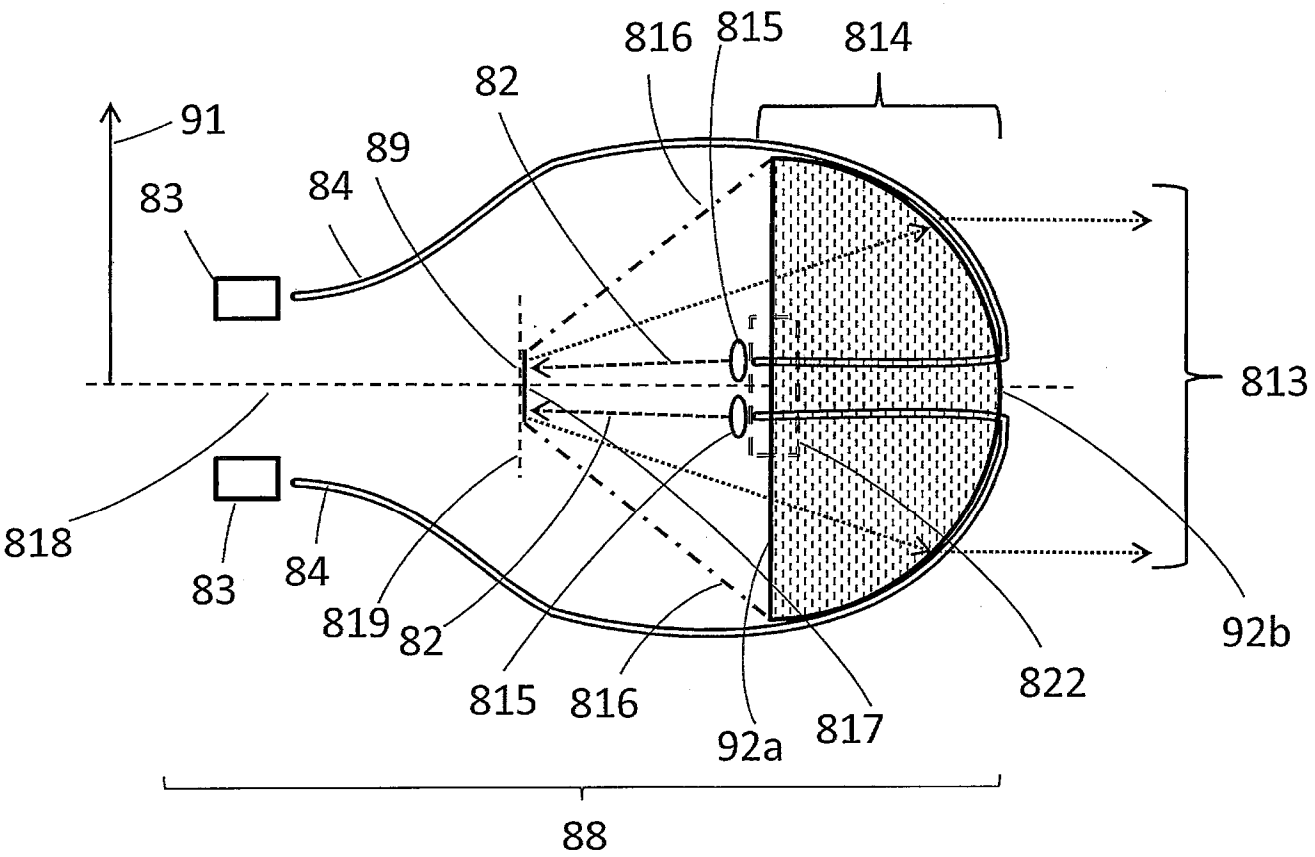
FIG. 9*c*: further detail of an embodiment of the present invention; illustration of protruding optical fibres with respect to the projection lens.
Figure 9D:
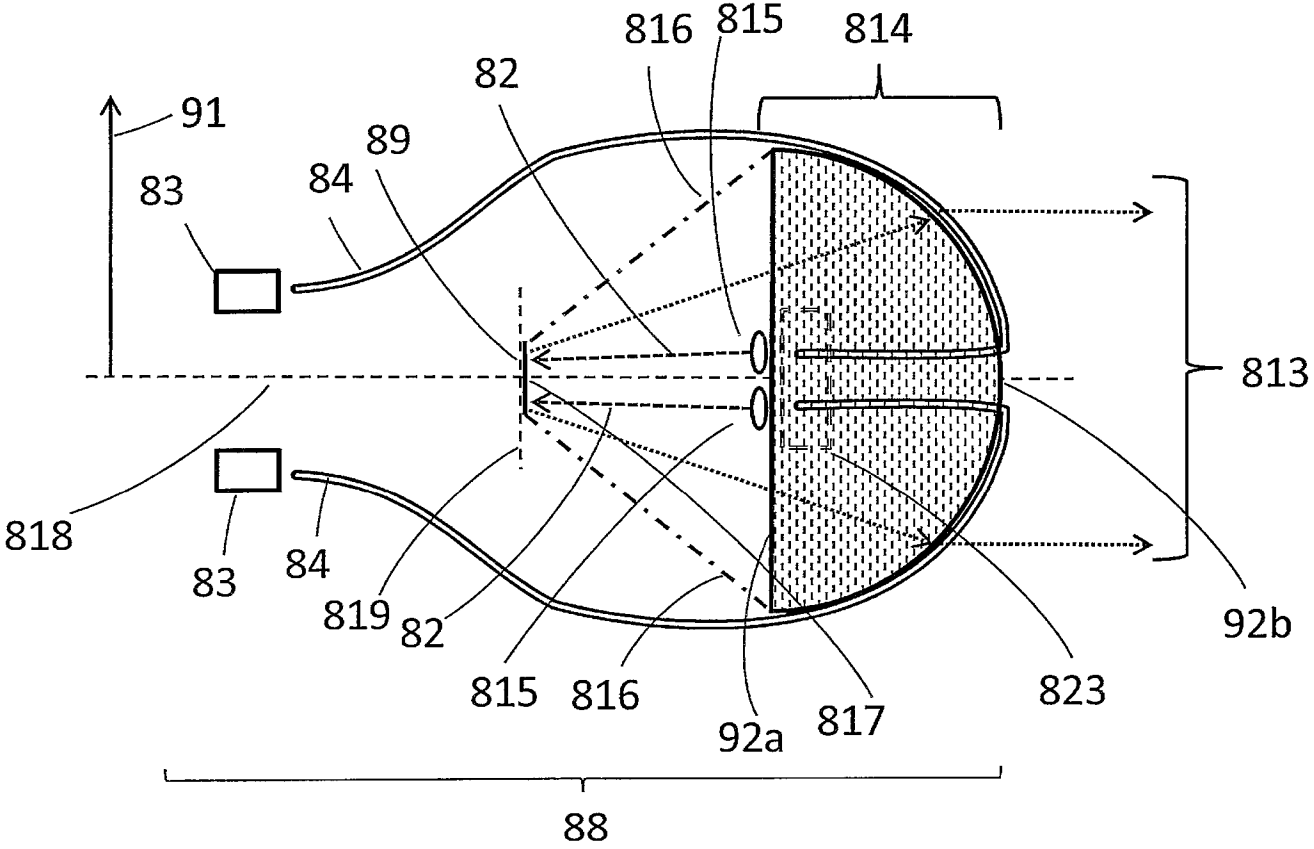
FIG. 9*d*: further detail of an embodiment of the present invention; illustration of recessed optical fibres with respect to the projection lens.

In the embodiment of FIG. 9*a* the optical fibres are shown as having their termination points (ie, their output faces) substantially flush with the surface of the converging lens that faces the surface of the photoluminescent material that is illuminated by the light beams generated by the optical fibres. (A light beam can be considered as created at the output face of the optical fibre, since this is the point that it may be considered as a beam as opposed to a guided mode within the fibre). The embodiment is not however limited to the optical fibres having their output faces flush with the surface of the converging lens. In a modification of the embodiment of FIG. 9*a* at least one of the optical fibres may have a termination point that protrudes 822 from the surface of the converging lens that faces the surface of the photoluminescent material illuminated by the light beams, as shown in FIG. 9*c*, and/or at least one of the optical fibres may have a termination point that is recessed 823 with respect to the surface of the converging lens that faces the surface of the photoluminescent material that is illuminated by the light beams, as shown in FIG. 9*d*. (Other features of the embodiments of FIGS. 9*c* and 9*d* are the same as the corresponding features of the embodiment of FIG. 9*a*, and their description will not be repeated.) By way of example, the arrangement of optical fibres within the body of the lens may be made by moulding the projection lens around the optical fibres. This would not affect the ability of the fibre to guide light as the cladding layer of the optical fibre is still between the core of the optical fibre and the material of the projection lens. By this method the optical fibres and projection lens material create a single unit. By way of further example, the fibres could be inserted into holes made within the projection lens. By this method the optical fibres and projection lens would consist of separate bodies. The method of manufacture should not be limited to only these two methods.

FIG. 9*a* appears to show that the optical fibres 84 cover the entire front external surface 92*b* of the projection lens 814. This is not the case. FIG. 9*b* shows the front view of the projection lens 814, i.e. as if viewed from the same side as the far-field projection. Some optical fibres 84 are shown traversing the front surface 92*b* of the projection lens 814. It is clear that the optical fibres 84 do not cover the entirety of the front external surface 92*b*, leaving the lens able to operate in its preferred mode.

Figure 10:
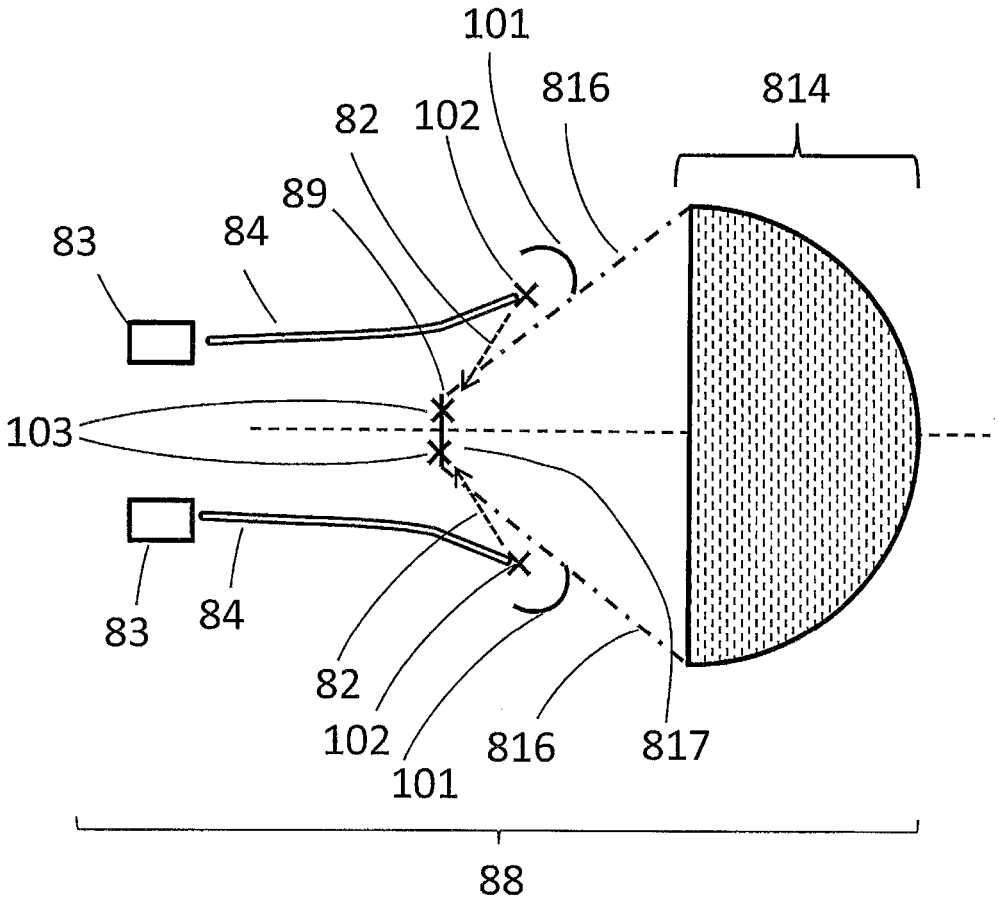
FIG. 10: further embodiment of the present invention; creation of an array of illumination spots upon the light source by imaging reflectors.

FIG. 10 shows a further embodiment of the present invention whereby the optical components for directing the output from a respective optical fibre onto a respective region of the light source 89 are ellipsoidal reflectors 101 rather than control lenses (815 from FIG. 8*c*). The ellipsoidal reflectors 101 are shaped such that they have a first focal point 102 and a second focal point 103. Light from the first focal point 102 is directed to the second focal point 103, thereby allowing an image of the first focal point 102 to be formed at the second focal point 103. The first focal point 102 coincides with the output face of the optical fibre 84. The second focal point 103 coincides with a point on the illuminated side 817 of the light source 89. Each of the second focal points 103 of the ellipsoidal reflectors 101 would generally be at a different location upon the light source 89. This allows the creation of an array of illumination spots upon the light source 89 in a manner similar to the main embodiment. As with previous embodiments, it is preferred if the ellipsoidal reflectors 101 are outside the angular acceptance range of the projection lens 814 (that is, are outside the acceptance cone 816 of the projection lens 814) as this will improve efficiency of operation. However, if necessary, it is possible for the ellipsoidal reflectors 101 to encroach within the acceptance cone 816 without significant loss of projection image quality of the light source 89. This arrangement is distinct over prior art due to the application of imaging reflective surfaces and has advantage over the prior art due to the utilisation of the imaging reflectors to create an array of shaped illumination spots upon the surface of the light source 89, without the need for moving parts. As in previous embodiments, it is possible for a single illumination spot upon the light source 89 to be illuminated by the image created by more than one ellipsoidal reflector 101.

Figure 11:
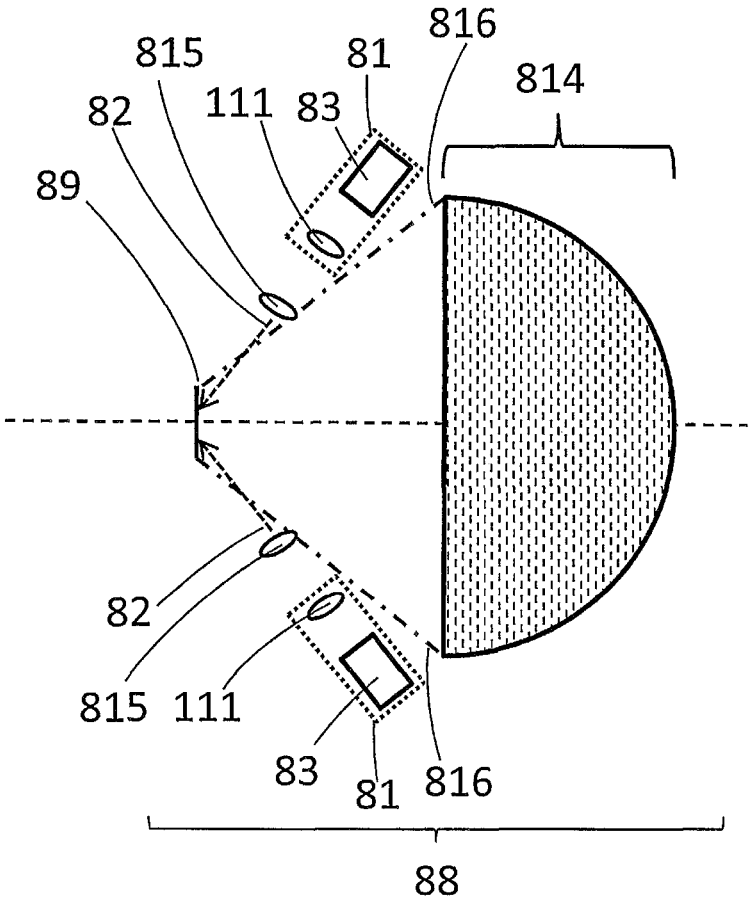
FIG. 11: further embodiment of the present invention; light beam generator comprising optical components for creation of specified brightness distributions and imaging by a lens onto the light source.

FIG. 11 shows a further embodiment of the present invention. A light source system 88 contains a light beam generator 81 which is formed by multiple laser emitters 83 and distribution control components 111 which are optical components that direct the output from a respective laser emitter onto a respective region of the light source 89. The distribution control components 111 create a brightness distribution with specified shape, size and uniformity at a specified plane. Such a distribution control component 111 may be a top hat lens. Top hat lenses are well known and will not be described further herein. The specified plane should be arranged to correspond with the focal plane of the control lenses 815. By this arrangement it is possible to create an array of illumination spots upon the surface of the light source 89 to achieve an adaptive far-field beam spot without the use of optical fibres.

Figure 12:
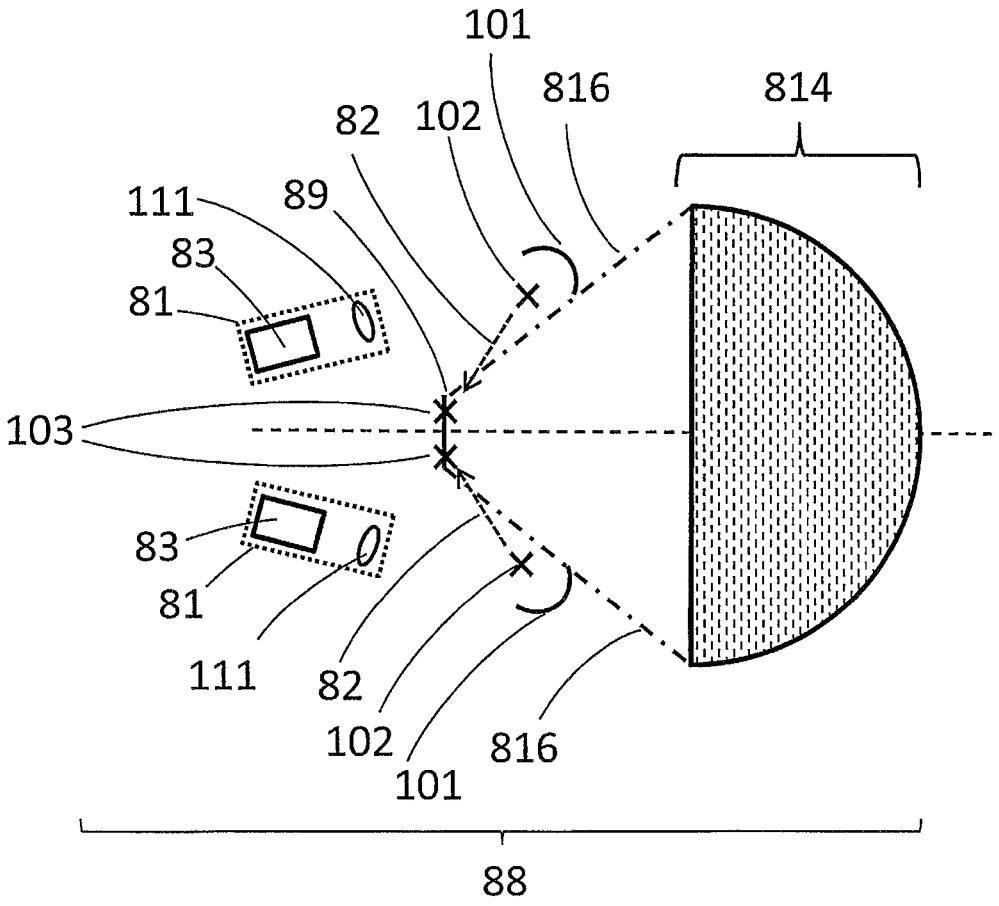
FIG. 12: further embodiment of the present invention; light beam generator comprising optical components for creation of specified brightness distributions and imaging by an ellipsoidal reflector onto the light source.

FIG. 12 shows a further embodiment of the present invention whereby the light source system 88 contains a light beam generator 81 which is formed by multiple laser emitters 83 and distribution control elements 111. The distribution control components 111 are arranged to create a brightness distribution at the first focal points 102 of ellipsoidal reflectors 101. The second focal points 103 of the multiple ellipsoidal reflectors 101 are arranged upon the surface of the light source 89. By this arrangement it is possible to create an array of illumination spots upon the surface of the light source 89 to achieve an adaptive far-field beam spot without the use of optical fibres. In this embodiment the distribution control elements 111 and the ellipsoidal reflectors 101 are optical components that direct the output from a respective laser emitter onto a respective region of the light source 89.

Figure 13:
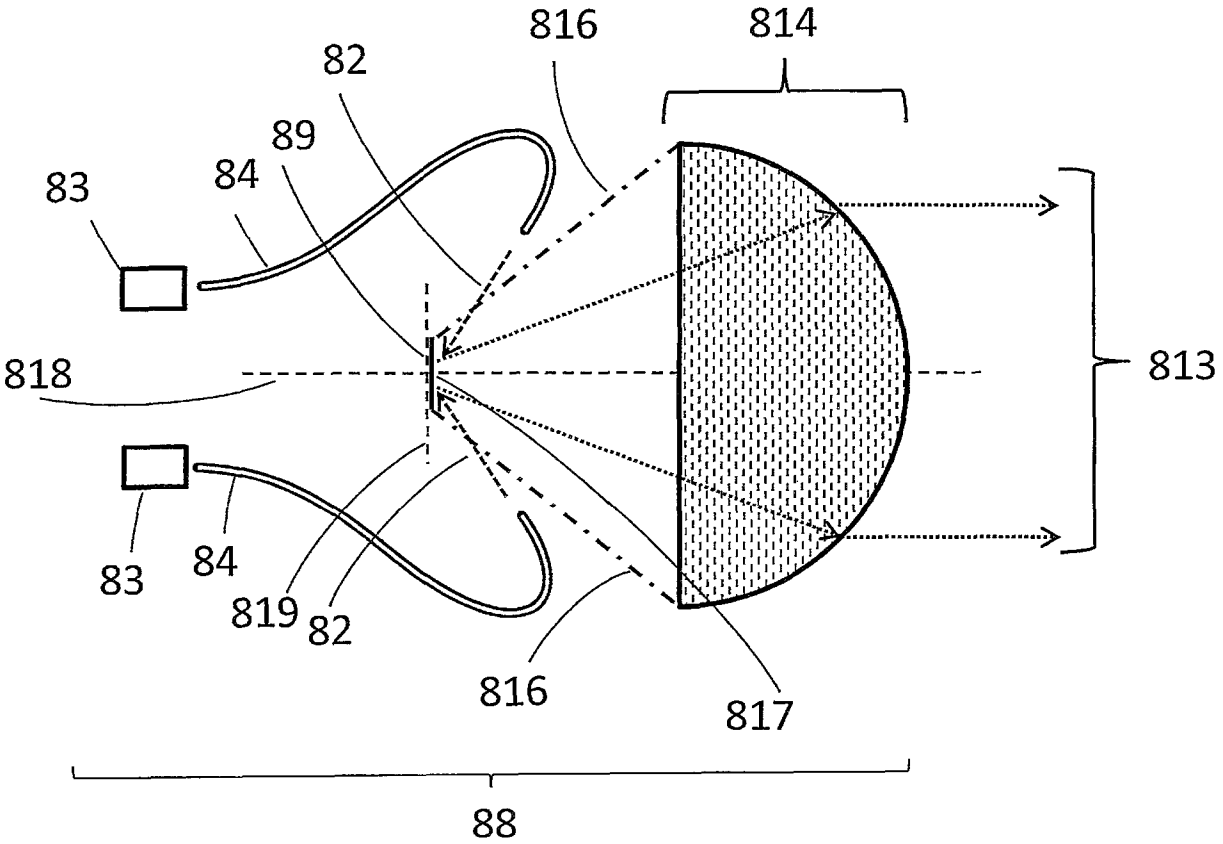
FIG. 13: further embodiment of the present invention; light beam generator illuminating a light source directly without further optical components.

FIG. 13 shows a further embodiment of the present invention whereby the imaging elements (control lenses, 815 in FIG. 8*b*, or ellipsoidal reflectors, 101 in FIG. 10) are removed from the system. By this arrangement it is still possible to form an array illumination pattern upon the light source 89, but one with less well defined illumination spot shapes or boundaries between illumination spots.

A further embodiment of the present invention is the ability to manipulate the position, size or orientation of the illumination spots within the array upon the light source. This may for example be effected by providing actuators capable of changing the position and/or orientation of the control lenses 815 of FIG. 8*b* relative to the output faces 85 of the optical fibres 84. Information on the manipulation of the laser beam generator and control lenses necessary to achieve this is described in full detail in co-pending UK patent application No 1213297.3. entitled "Headlight System Incorporating Adaptive Beam Function" in the name of Sharp Kabushiki Kaisha, which is hereby associated by reference. Therefore, it will not be described herein, but considered included by association. This embodiment may be applied to any of the preceding embodiments.

Figure 14:
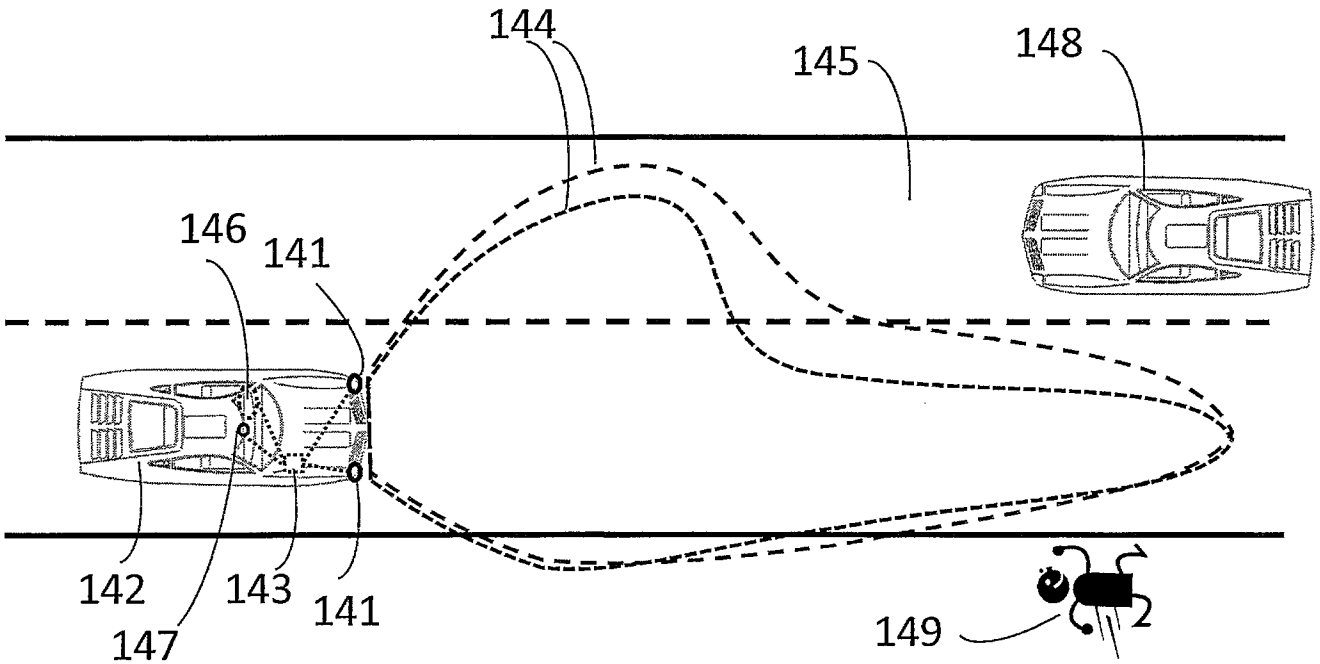
FIG. 14: system overview of the present invention.

FIG. 14 shows a system view how the present invention may be utilised. It may be used within the headlight unit 141 of an automobile 142. The headlight units 141 are controlled by a central control unit 143. The control unit changes the output from the headlight units 141 to alter the beam spot distribution 144 on the road 145 in response to input from either the driver console 146 or a signal from an automatic system which detects the conditions of the road 145, e.g. a camera 147. The beam spot may be modified to account for the presence of oncoming automobiles 148 or other hazards, for example a pedestrian 149 about to enter the road 145.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

INDUSTRIAL APPLICABILITY

The present invention can be applied to the automotive industry and more specifically the provision of advanced adaptive front lighting systems to the headlights of automobiles.

SUPPLEMENTAL NOTES

A first aspect of the invention provides a light source system operable in at least first and second modes to provide at least and first and second different far field illumination patterns, the system comprising: a photoluminescent material; and an optical system arranged to image light emitted from the photoluminescent material into the far-field, the optical system comprising a converging lens; and a light beam generator for generating at least first and second independently controllable sets of one or more light beams for illuminating respective regions of the photoluminescent material; wherein the light beam generator comprises at least one semiconductor light emitting device spatially separated from the photoluminescent material; and wherein the light source system is arranged so that the first and second sets of one or more light beams illuminate, in use, a surface of the photoluminescent material facing the converging lens. By causing the generating means to generate a first set of one or more light beams so as to illuminate one region of the photoluminescent material, the one region of the photoluminescent material is caused to emit visible light and thus generate one far field illumination pattern, whereas causing the generating means to generate a second set of one or more light beams so as to illuminate another region of the photoluminescent material, the another region of the photoluminescent material is caused to emit visible light and thus generate another far field illumination pattern. By specifying that the sets of light beams are independently controllable is meant that the intensity of the light beam(s) of one set is controllable independently of the intensity of the light beam(s) of the other set, and optionally that the or any light beam of one set is controllable independently of the intensity of the or any light beam of the other set. (It should be noted that the region of the photoluminescent material that is illuminated by a first set of light beams may or may not overlap the region of the photoluminescent material that is illuminated by a second set of light beams.)

For the avoidance of doubt, the first set of light beams and/or the second set of light beams may consist of only a single light beam.

The photoluminescent material may be a fluorescent material, such as a fluorescent phosphor.

For the avoidance of doubt, the term "phosphor" as used herein includes a nanophosphor.

Also for the avoidance of doubt, a light source system of the invention is not necessarily limited to operation in just the first and second modes and in principle may also be operable in one or more further modes in addition to the first and second modes, so that the system is able to provide one or more further far field illumination patterns in addition to, and different from, the first and second different far field illumination patterns.

The optical system may consist solely of the converging lens.

The light beam generator may comprise a plurality of semiconductor light emitting devices spatially separated from the photoluminescent material.

The system may comprise a plurality of optical fibres, each optical fibre receiving at its input face light from a respective light emitting device, the output from an optical fibre defining providing a light beam for illuminating a region of the photoluminescent material. The number of light-emitting devices may be the same as the number of optical fibres, with each light-emitting device illuminating a single optical fibre and each optical fibre receiving light from a single light-emitting device. This provides that greatest possible degree of control over the regions of the photoluminescent material that are illuminated. The invention is not however limited to a one-to-one correspondence between the optical fibres and the light-emitting devices.

The system may comprise a plurality of optical components for directing the output from a respective optical fibre onto a respective region of the photoluminescent material.

The system may comprise one or more optical components for directing the output from a respective light emitter onto a respective region of the photoluminescent material.

The optical components may comprise lenses.

The optical components may comprise reflectors.

The semiconductor light emitting device(s) may be disposed on the same side of the photoluminescent material as the optical system.

The optical fibres may be positioned outside the angular acceptance range of the converging lens.

The optical component(s) may be positioned outside the angular acceptance range of the converging lens.

The light emitting device(s) may be positioned outside the angular acceptance range of the converging lens.

The optical fibres may pass at least partially through the converging lens.

At least one of the optical fibres may have a termination point substantially flush with a surface of the converging lens facing the surface of the photoluminescent material illuminated by the light beams.

At least one of the optical fibres may have a termination point protruding from a surface of the converging lens facing the surface of the photoluminescent material illuminated by the light beams.

At least one of the optical fibres may have a termination point recessed with respect to a surface of the converging lens facing the surface of the photoluminescent material illuminated by the light beams.

The spacing between the optical component(s) and a surface of the converging lens facing the photoluminescent material may be no greater than 0.75 of a focal length of the converging lens.

The optical component(s) may be disposed adjacent to a surface of the converging lens facing the photoluminescent material.

A second aspect of the invention provides a headlight for a motor vehicle comprising a light source system of the first aspect.

The first far-field illumination pattern may provide a dipped beam.

The second far-field illumination pattern may provide a driving beam.

If a system of the invention is operable also in one or more further modes to provide one or more further far field illumination patterns, the further far-field illumination pattern(s) may provide adaptive control to the driving beam and/or the dipped beam.

A third aspect of the invention provides a vehicle comprising a headlight of the second aspect.

The prior art outlined above addresses the provision of a small headlight through the use of laser excitation of fluorescent materials and the ability to create both dipped and driving beam spot with some adaptive control. However, they do not allow for a high powered non-mechanical, switchable dipped to driving beam headlight with further adaptive capability which can not only create the dipped and driving beam spots, but can also offer adaptive control of the range of beam spots possible and/or of the point where the cut-off is provided to obtain the dipped beam. This invention aims to address that deficiency. Removal of mechanical parts from the headlight offers advantage in both cost of manufacture and reliability of the headlight unit over its lifetime. Furthermore, the current invention can provide for a projector-type headlight which can create a dipped beam profile without the use of a shield to remove light from the projected beam, thereby increasing optical efficiency of the headlight. The current invention offers further improvement in efficiency and reproduction of the far-field distribution of the light source by removal of a reflector from the optical system. Instead the current invention utilises solely a projection lens. Additional improvement in efficiency may be provided by the location of the optics associated with the light beam being located outside of the acceptance cone of angles of the projection lens.

Furthermore in the lamp module of U.S. Pat. No. 7,654,712 each light emission part is located adjacent to the associated fluorescent substance. In operation the light emission part and the fluorescent substance will both generate heat, and because the light emission part is located adjacent to the associated fluorescent substance it will be difficult to remove this waste heat efficiently. In the present invention, however, the semiconductor light emitting device(s) are spatially separated from the photoluminescent material, so that the waste heat generated by the semiconductor light emitting device can be dealt with separately from the waste heat generated by the photoluminescent material.

The light beam generator may comprise a plurality of independently controllable semiconductor light emitting devices spatially separated from the photoluminescent material, each generating a respective beam.

The light beam generator may comprise a plurality of independently controllable semiconductor light emitting devices the light emission from which is coupled into optical fibres, all of which are spatially separated from the photoluminescent material.

The light beam generator may comprise a plurality of independently controllable semiconductor light emitting devices the light emission from which is distributed into a specified brightness distribution at a given location by a further optical component, all of which are spatially separated from the photoluminescent material.

The optical fibres within the light beam generator may be configured to have specifically shaped cores. The shapes may be such that the illumination of the photoluminescent material can be an array.

The further optical components for generation of specified brightness distribution may create shapes that allow the illumination of the photoluminescent material to be in an array.

The shaped distribution of the optical fibres or the further optical components may be imaged onto the photoluminescent material by imaging lenses.

The shaped distribution of the optical fibres or the further optical components may be imaged onto the photoluminescent material by ellipsoidal imaging reflectors.

The light beam generator may be positioned such that all components, as outlined above, are located outside of the acceptance cone angle of the projection lens.

The light beam generator may be position such that some portion of the components, as outlined above, are located within the acceptance cone angle of the projection lens.

The light beam generator may be positioned such that the optical fibre component is arranged to be passing through the projection lens and the imaging lenses associated with each optical fibre are located in close proximity to the projection lens.

The semiconductor light emitting device(s) may be laser emitter(s) or they may be light emitting diode(s).

The light beam generator may be arranged to generate light beam for illuminating a photoluminescent material in an array of illumination spots.

The array of illumination spots upon the photoluminescent material may be comprised of multiple shapes, size or orientations as outlined in co-pending UK patent application GB 1122183.5, which is hereby incorporated by reference.

Finer control of the position, size or orientation of the illumination spots within the array upon the photoluminescent material may be effected by methods outlined in co-pending UK patent application No. 1213297.3 entitled "Headlight System Incorporating Adaptive Beam Function" in the name of Sharp Kabushiki Kaisha, which is hereby incorporated by reference.

The invention claimed is:

1. A light source system operable in at least first and second modes to provide at least first and second different far field illumination patterns, the system comprising:

a photoluminescent material;

an optical system arranged to image light emitted from the photoluminescent material into the far field, the optical system comprising a converging lens; and a light beam generator for generating at least first and second independently controllable sets of one or more light beams for illuminating respective regions of the photoluminescent material, wherein the light beam generator comprises at least one semiconductor light emitting device spatially separated from the photoluminescent material; and a plurality optical components for directing the output from a respective light emitting device onto a respective region of the photoluminescent material;

wherein the light source system is arranged so that the at least first and second independently controllable sets of one or more light beams are incident, in use, on a surface of the photoluminescent material facing the converging lens and which illuminate, in use, respective different regions on the surface of the photoluminescent material with no overlap or only partial overlap; and wherein the one or more optical components are fixed in their position such that the respective illuminated regions on the photoluminescent material have a fixed position.

2. A system as claimed in claim 1 wherein the optical system consists solely of the converging lens.

3. A system as claimed in claim 1 wherein the light beam generator comprises a plurality of semiconductor light emitting devices spatially separated from the photoluminescent material.

4. A system as claimed in claim 1 and comprising a plurality of optical fibres, each optical fibre receiving at its input face light from a respective light emitting device, the output from an optical fibre defining providing a light beam for illuminating a respective region of the photoluminescent material.

5. A system as claimed in claim 4, wherein the one or more optical components comprise a plurality of optical components for directing the output from a respective optical fibre onto a respective region of the photoluminescent material.

6. A system as claimed in claim 5 wherein the optical components comprises lenses.

7. A system as claimed in claim 5 wherein the optical components comprises reflectors.

8. A system as claimed in claim 1 wherein the semiconductor light emitting device(s) are disposed on the same side of the photoluminescent material as the optical system.

9. A system as claimed in claim 4 wherein the optical fibres are positioned outside the angular acceptance range of the converging lens.

10. A system as claimed in claim 5 wherein the optical component(s) are positioned outside the angular acceptance range of the converging lens.

11. A system as claimed claim 1, wherein the light emitting device(s) are positioned outside the angular acceptance range of the converging lens.

12. A headlight for a motor vehicle comprising a light source system as defined in claim 1.

13. A headlight as claimed in claim 12 wherein the first far-field illumination pattern provides a dipped beam.

14. A headlight as claimed in claim 12 wherein the second far-field illumination pattern provides a driving beam.

15. A vehicle comprising a headlight as defined in claim 12.

16. A light source system operable in at least first and second modes to provide at least and first and second different far field illumination patterns, the system comprising:

a photoluminescent material;

an optical system arranged to image light emitted from the photoluminescent material into the far-field, the optical system comprising a converging lens;

a light beam generator for generating at least first and second independently controllable sets of one or more light beams for illuminating respective regions of the photoluminescent material, the light beam generator comprising at least one semiconductor light emitting device spatially separated from the photoluminescent material; and a plurality of optical fibres, each optical fibre receiving at its input face light from a respective semiconductor light emitting device, the output from an optical fibre defining providing a light beam for illuminating a region of the photoluminescent material;

wherein the optical fibres pass at least partially through the converging lens; and wherein the light source system is arranged so that the first and second sets of one or more light beams illuminate, in use, a surface of the photoluminescent material facing the converging lens.

17. A system as claimed in claim 16 wherein at least one of the optical fibres has a termination point substantially flush with a surface of the converging lens facing the surface of the photoluminescent material illuminated by the light beams.

18. A system as claimed in claim 16 wherein at least one of the optical fibres has a termination point protruding from a surface of the converging lens facing the surface of the photoluminescent material illuminated by the light beams.

19. A system as claimed in claim 16 wherein at least one of the optical fibres has a termination point recessed with respect to a surface of the converging lens facing the surface of the photoluminescent material illuminated by the light beams.

* * * * *